US005425554A

United States Patent [19]

Lamanna

[11] Patent Number: 5,425,554

[45] Date of Patent: Jun. 20, 1995

[54] BINDING ELEMENT

[75] Inventor: Saverio Lamanna, Milan, Italy

[73] Assignee: Sisam SA, Lugano, Switzerland

[21] Appl. No.: 133,308

[22] Filed: Oct. 8, 1993

[30] Foreign Application Priority Data

Oct. 9, 1992 [BE] Belgium ..... 9200880
Sep. 1, 1993 [EP] European Pat. Off. ..... 93202559

[51] Int. Cl.[6] ..... B42D 1/06; B42D 3/02

[52] U.S. Cl. ..... 281/21.1; 281/15.1; 281/36; 281/37

[58] Field of Search ..... 281/21.1, 36, 15.1, 281/23, 34, 35, 37, 29, 28

[56] References Cited

U.S. PATENT DOCUMENTS 2,782,056 2/1957 Allegretti ..... 281/21.1
3,292,951 12/1966 Schoenberger ..... 281/21.1 X
3,840,254 10/1974 Shatzkin ..... 281/21.1
3,957,287 5/1976 Hall et al. ..... 281/21.1
5,078,563 1/1992 Lolli ..... 281/21.1 X
5,340,155 8/1994 Podosek ..... 281/21.1 X

FOREIGN PATENT DOCUMENTS 240176 10/1986 German Dem. Rep. ..... 281/21.1
1289821 2/1969 Germany ..... 281/21.1
1029687 5/1966 United Kingdom ..... 281/21.1
2145033 3/1985 United Kingdom ..... 281/21.1
2197256 5/1988 United Kingdom .

*Primary Examiner*—Frances Han
*Attorney, Agent, or Firm*—Bacon & Thomas

[57] ABSTRACT

A binding consists of a file composed of one or more parts. The back of the binding contains an element enclosed in a hard heat conducting material. An inside portion of the back is provided with an amount of glue which melts under the influence of heat for maintaining the file, at least partially, adjacent to the inside portion of the element.

16 Claims, 4 Drawing Sheets

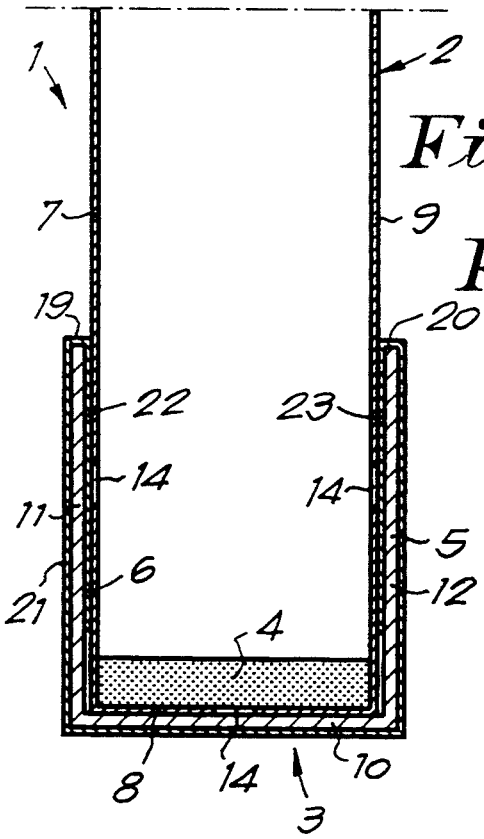
Fig.5
Fig.6
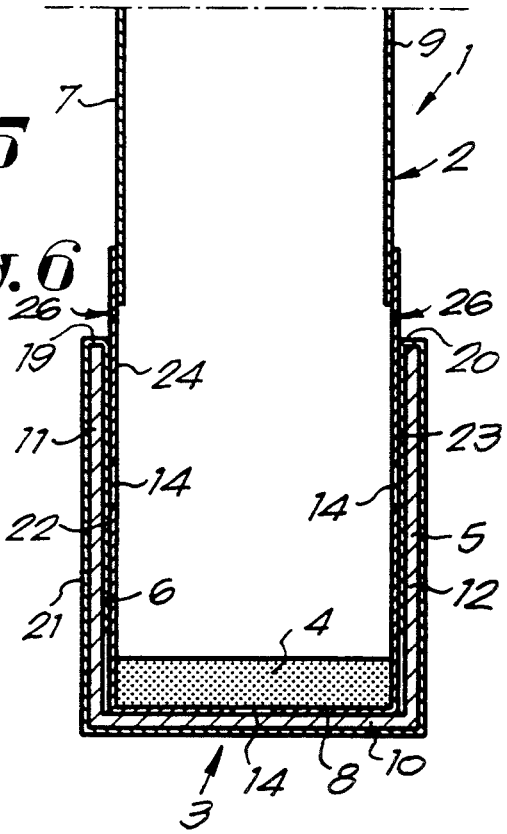
Fig.8
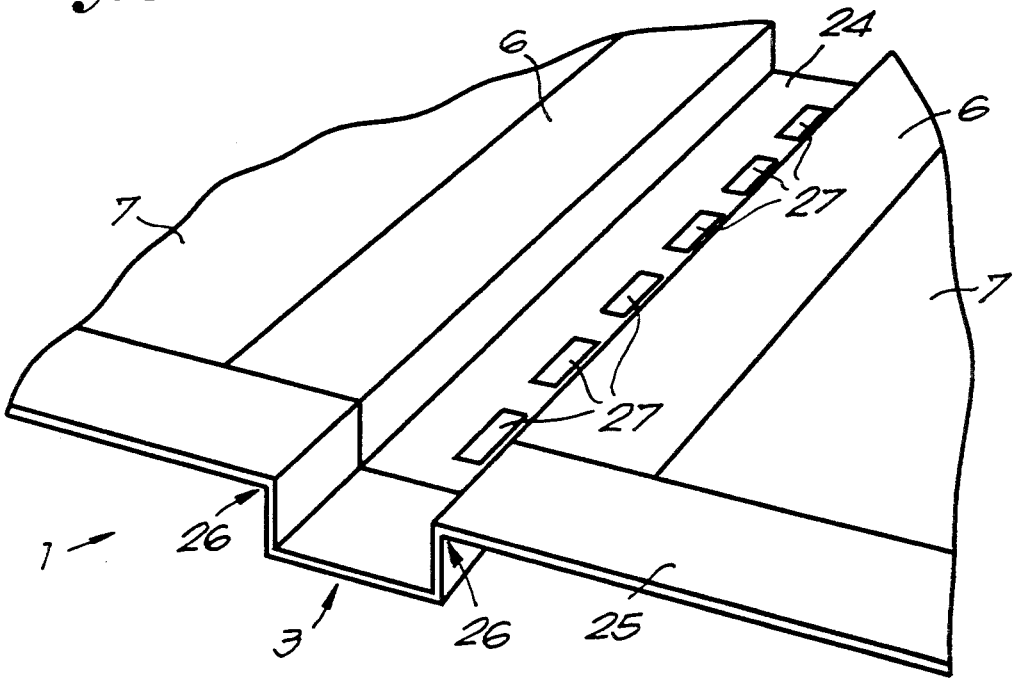

Fig.10
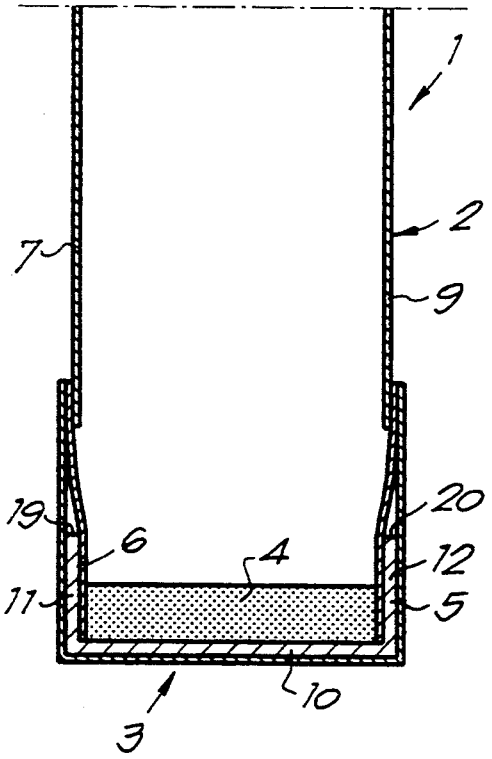
Fig.11
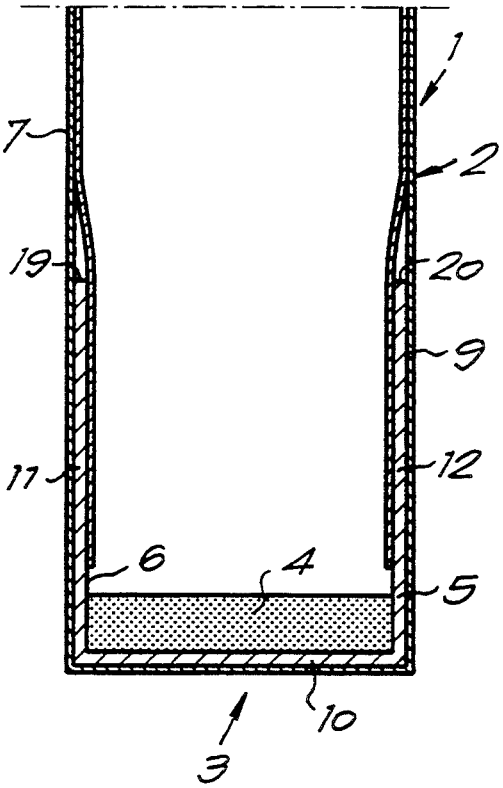
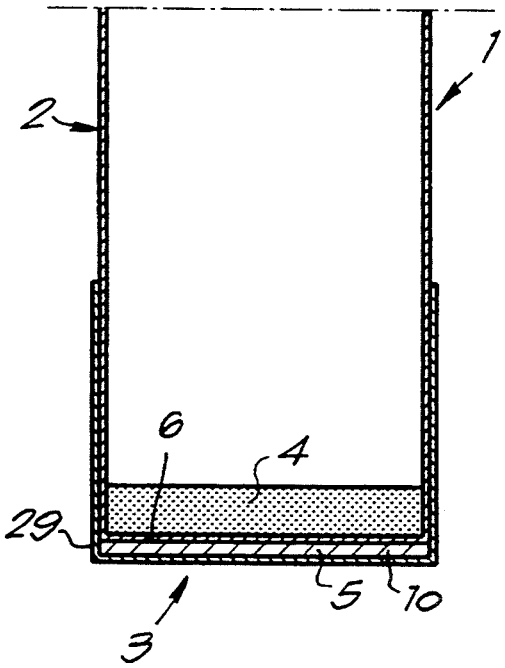
Fig.12

BINDING ELEMENT

BACKGROUND OF THE INVENTION

The present invention relates to a binding element, more specifically to a binding element of the type of which the inside of the back is provided with an amount of glue which melts under the influence of heat.

Binding elements of the above-mentioned type are widely known. In order to bind a bundle of sheets or documents by means of such binding element, the sheets are placed in contact with the glue in the binding element. Consecutively, the whole is placed vertically, the back facing down, on a heating element, so that the glue melts and the sheets intrude in the glue layer. After the binding element has been taken off the heating element, the glue hardens, with as a result that the sheets are retained in the binding element by means of the glue.

In order to obtain that the heat of the heating element is fed to the glue in an efficient way, more specifically is spread very equally, it is also known to apply an element of a heat conducting material, such as metal, in the back.

It is also known that the above-mentioned element can consist of a metal U-shaped profile. An example thereof is disclosed in GB 2.197.156. The use of such U-shaped profile also offers the advantage that, when laying the bound bundle open, respectively turning the pages thereof, the glue connections between the sheets, as well as the glue connections between the sheets themselves, is burdened little or not at all, thus avoiding that the sheets come loose.

According to GB 2.197.156, the U-shaped profile is located at the inside of the file. The binding element therefore has the disadvantage that it is very user-unfriendly, as it is very difficult to slide all sheets into the U-shaped profile, especially with thick bundles. Indeed, the outer sheets end up on the edge of the relatively thick metal profile.

SUMMARY OF THE INVENTION

The invention therefore aims at a binding element whereby the above-mentioned disadvantage is excluded, and more specifically at a binding element whereby said heat conducting element, whether this has a U-shaped section or not, does not trouble when inserting a bundle of loose documents in this binding element.

To this end, the invention relates to a binding element, consisting of an actual file which is made of one or more parts, the back of which contains an element in a hard heat conducting material, and whereby the back is provided at its inside with an amount of glue which melts under the influence of heat, characterized in that the file, at least partially, is adjacent to the inside of said element. As the file is at least partially adjacent to the inside of the heat conducting element, loose sheets which are inserted in the file can slide into the right position in an unhindered way.

Indeed, in case a U-shaped heat conducting element is used, the sheets to be bound are lead as far as next to the upright walls of the U-shaped element.

In case a flat heal conducting element is used, it is excluded that the outer sheets end up next to the heat conducting element.

The portions of the file adjacent to the inside of the heat conducting element are preferably glued to the latter, for instance with a once-only activatable glue. This is especially important when a continuous inner cover is applied against the heat conducting element, as such glued connection ensures that the inner cover is always in perfect contact with the heat conducting element, and thus the glue for binding the documents is also in perfect contact with the heat conducting element.

BRIEF DESCRIPTION OF THE DRAWINGS

In order to better illustrate the characteristics according to the invention, some preferred embodiments are described hereafter, as examples with no limiting character whatsoever, reference being made to the accompanying drawings, in which:

FIGS. 4 to 7 represent four variants of binding elements according to the invention;

FIG. 8 represents a part of the binding element of FIG. 7 in opened position;

FIGS. 9 to 12 represents four more variants of binding elements according to the invention.

DETAILED DESCRIPTION OF THE PREFERRED EMBODIMENTS

Figure 1:
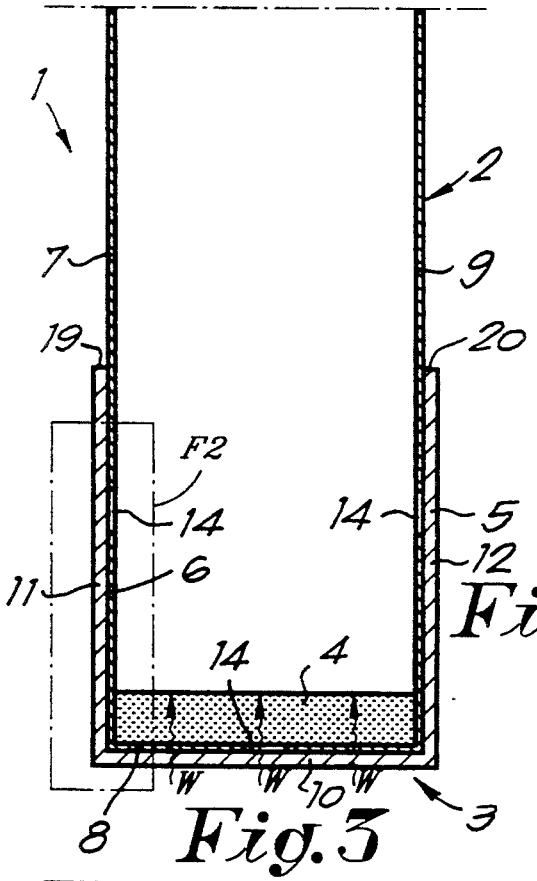
FIG. 1 represents a cross-section of a binding element according to the invention.

As represented in FIG. 1, the invention relates to a binding element 1, consisting of, on the one hand, an actual file 2 which is composed of one or more parts, and provided at the inside of its back 3 with an amount of glue 4 which melts under influence of heat, and on the other hand, an element 5 in a hard and heat conducting material, applied at the back 3.

The particularity of the invention exists in that the file 2, at least partially, thus with a number of components parts thereof, is adjacent to the inside 6 of said element 5.

This characteristic can be realized in different ways. To this end, in the embodiment of FIG. 1, the file 2 is formed of one continuous sheet of paper, synthetic material or the like which is attached to the inside 6 of the element 5. Thus the sheet forms a front sheet 7, a back portion 8 and rear sheet 9. Said glue 4 consists of a strip of hardened adhesive which is applied to the inside of the back portion 8.

According to FIG. 1, the element 5 consists of a U-shaped profile with rectangular section, formed of a back wall 10 and two side walls I! and 12.

Preferably, the file 2 fits tightly against the inside 6 of the element 5, or at least fits tightly against the back wall 10 of the element 5, so that the heat transfer W of the element 5 to the glue 4 is optimal and for example not hindered by air inclusions or the like. Preferably, the portions of the file 2 adjacent to the inside 6 are therefore, with their entire surface or not, adhered to the latter, as is represented in the detail view of FIG. 2. To this end, use can be made of a thin layer of glue 13. The glue is of such a kind that it will not come loose during the heating when binding documents. To this end, use can be made of a thermo-activatable glue, the melting temperature of which is considerably higher than the binding temperature, a once-only thermo-activatable glue or a non-thermic glue.

Figure 2:
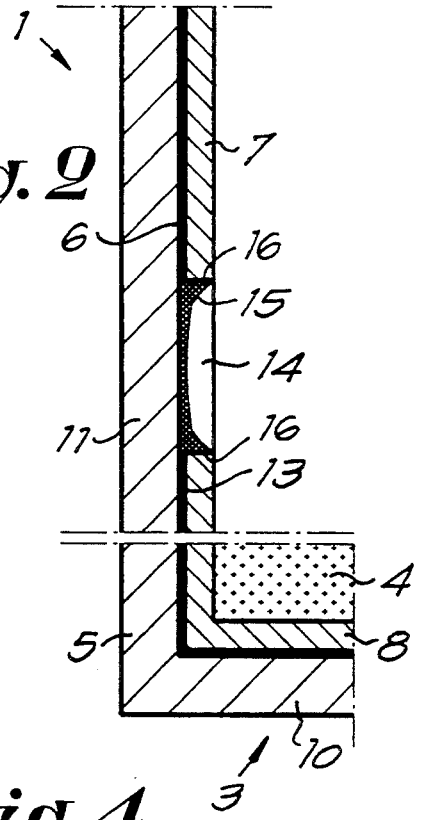
FIG. 2 represents the part marked with F2 in FIG. 1, of an enlarged scale.

As is represented further in FIGS. 1 and 2, openings 14 can be applied in the portions of the file 2 adjacent to the inside 6, which allow a bulge 15 of the glue, thus causing that a better adhesion is obtained, especially around the edges 16 of the openings 14.

It is to be noted that instead of a connection by means of the glue 13, according to an embodiment not represented in the figures, the portions of the file 2 adjacent to the inside 6 of the element 5 can also be clenched in the latter.

Figure 3:
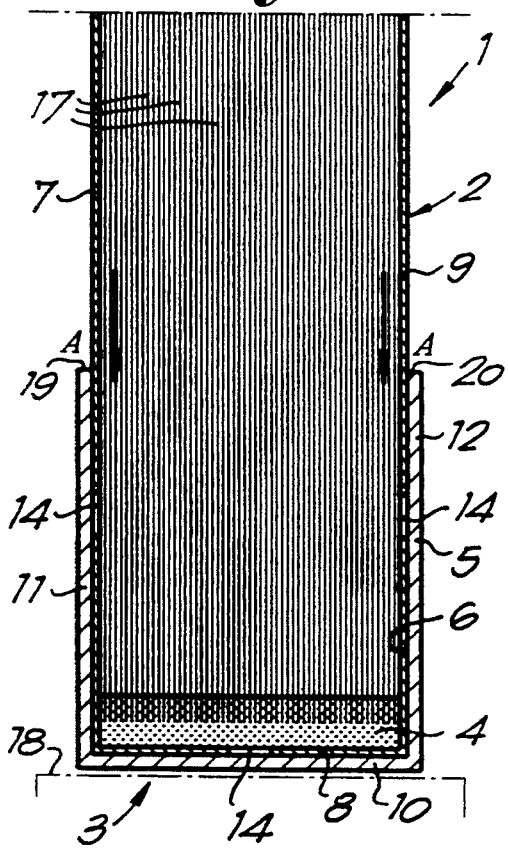
FIG. 3 represents the binding element of FIG. 1 during use.

FIG. 3 represents the use of the binding element 1 of FIG. 1. During the binding, the binding element 1 is placed on a heating element 18, together with the documents 17 to be bound. Hereby, the glue 4 melts and the documents 17 intrude at their bottom edges in the glue 4. After the whole has hardened again, the documents 17 are secured in the binding element 1.

It is clear that, during the insertion in the binding element 1, the documents 17 can easily glide according to arrows A between the side walls 11 and 12 of the U-shaped element 5, respectively can be tapped between them, thanks to the fact that the file 2 is adjacent to the inside of the element 5. Indeed, the documents 17 cannot end up on the relatively wide edges 19 and 20 of the element 5.

Figure 4:
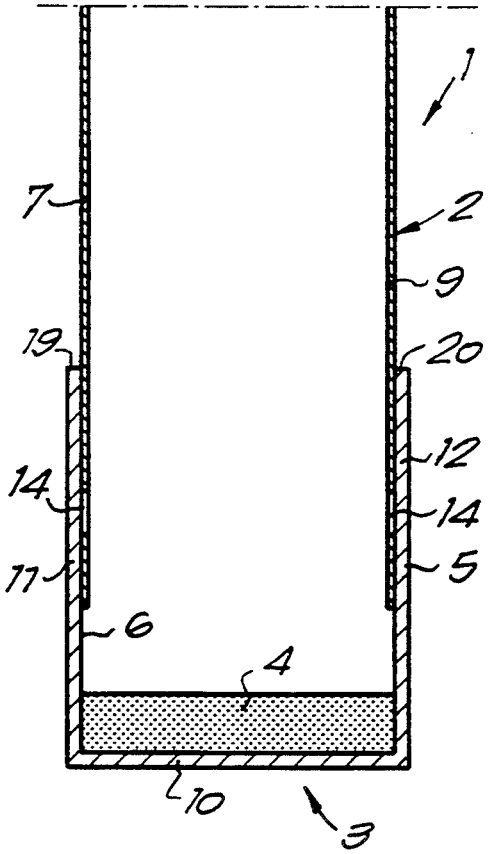

In FIG. 4 a variant is represented whereby the front sheet 7 and the rear sheet 9 of the file 2 consist of separate sheets which are both attached to the inside 6 of the respective side walls 11 and 12, preferably by means of glueing. The sheets 7 and 9 can hereby also be provided with openings 14 as described above.

According to the embodiment of FIG. 4, the glue 4 can be directly applied to the element 5.

As represented in FIGS. 5 and 6, the element 5 can be provided with a covering 21, for example a material with an elegant aspect, for example printed paper. The covering 21 is preferably folded over the edges of the element 5, whereby the folded parts 22 and 23 are located between the side walls 11 and 12 and the front sheet 7 and the rear sheet 9.

It is to be noted that in FIG. 5 an embodiment is represented whereby the front sheet 7, the back portion 8 and the rear sheet 9 are made of one sheet, while FIG. 6 represents an embodiment whereby use is made of a separate front sheet 7, rear sheet 9 and a connection strip 24 which is adjacent to the element 5, respectively to the folded parts 22 and 23. The sheets 7 and 9 are hereby only attached to the connection strip 24, preferably by means of glueing. The build-up of FIG. 6 is of course also possible without the covering 21 being present.

The build-up with the connection strip 24 is especially suitable in case that is opted for a front sheet 7 and/or rear sheet 9 of a relatively stiff material, for example transparent synthetic foil. The connection strip 24 can than be made of a more supple material than the front sheet 7 and the rear sheet 9, so that the folding open of the binding element 1, despite the use of a front sheet 7 and/or rear sheet 9 of a relatively stiff material, is not hindered.

Figure 7:
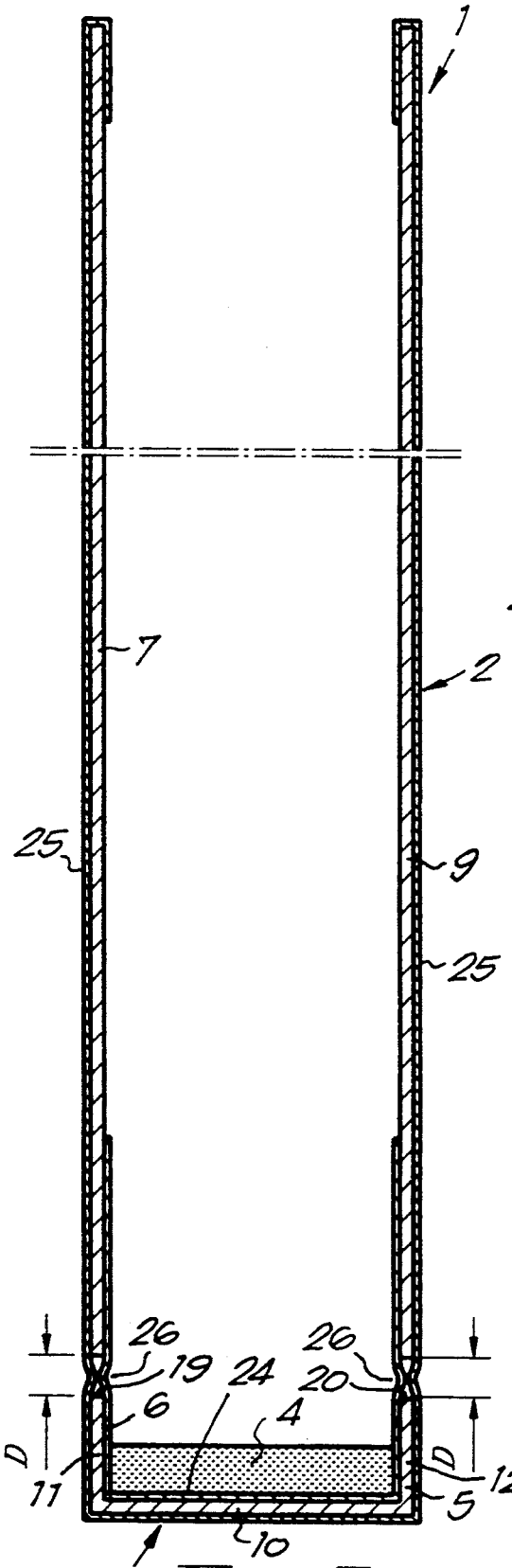

According to the embodiment in FIG. 7 the front sheet 7 and rear sheet 9 both consist of a cardboard plate. At the inside a connection strip 24 is applied, for example made of paper, which is adjacent to the inside of the element 5, and is preferably glued to the latter.

The whole is covered with an outer cover 25, preferably with an elegant aspect, for example of printed or coloured paper, with or without relief. The outer covering 25 can be folded at all edges of the binding element 1.

As is further represented in FIG. 7, the front sheet 7 and the rear sheet 9 are attached at a certain distance D from the element 5, so that folding zones 26 are formed, which allows the binding element 1 to be folded open as represented in FIG. 8. These folding zones 26 are also indicated in FIG. 6.

As represented in FIG. 8, openings 27 can be applied in the material of the file 2 that is adjacent to the inside 6 of the element 5, which allow the direct heat transfer from the heat conducting element 5 to the glue 4. Preferably, these openings 27 exist in a continuous perforation over the entire back. According to a variant, which is not represented, one long continuous excision can be provided.

Figure 9:
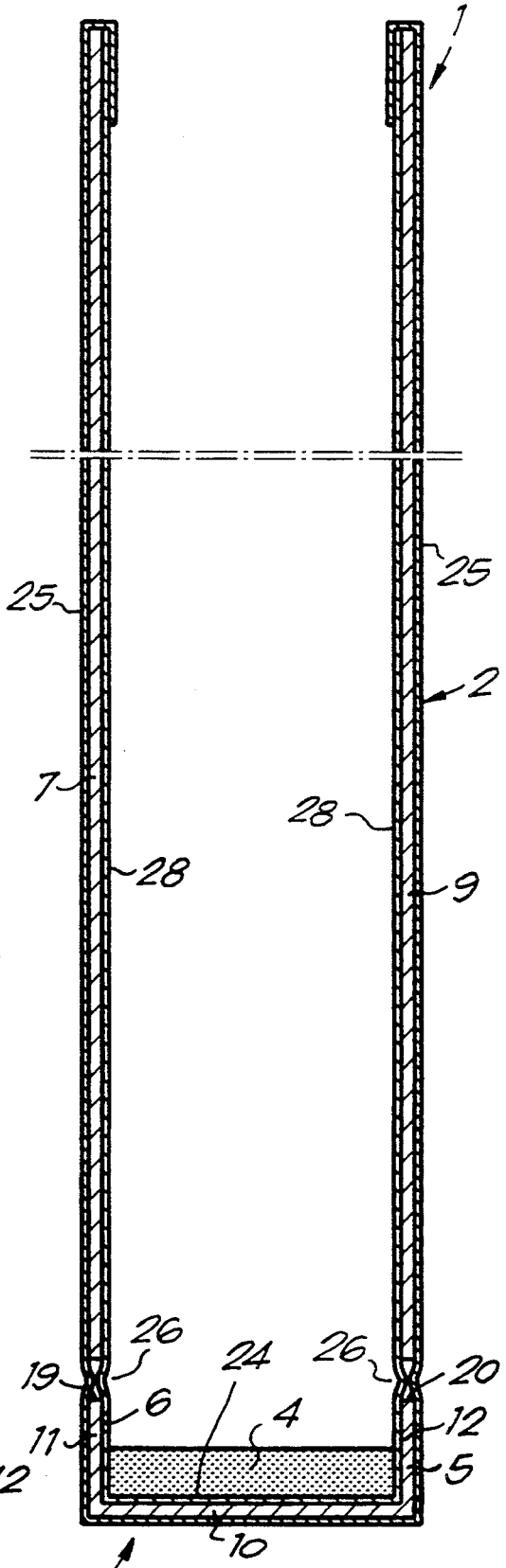

In FIG. 9, a variant of FIG. 7 is represented, whereby the connection strip 24 forms part of a continuous inner covering 28.

FIGS. 10 and 11 represent two further variants whereby the glue 4 is in direct contact with the element 5.

FIG. 12 represents a variant whereby the heat conducting element 5 consists of a flat strip. As the file 2 is hereby adjacent to the inside 6 of the element 5, with which is meant the side directed towards the inside of the binding element 1, it is excluded that documents 17 which are inserted in the binding element 1 end up next to the element 5. It is clear that also in this case the file 2 can be assembled in different forms. The example of FIG. 12, in which the actual file 2 consists of a front sheet 7, a back portion 8 and a rear sheet 9 which are made of one single sheet of paper, synthetic material or the like, and a covering strip 19 which is applied to the outside of the element 5, is therefore in no way limitative.

In the above-described embodiments, the element 5 is preferably made of metal and in the most preferred embodiment of steel. It is to be understood that by the above-mentioned expression "hard material" is meant that the element 5 is made of a material which is little or not bendable and is certainly less bendable than paper or synthetic foil.

It is clear that the different characteristics of different embodiments can be mutually combined.

The present invention is in no way limited to the embodiments described above and represented in the drawings, but such binding element can be realized in different forms and dimensions without leaving the scope of the invention as defined in the enclosed claims.

I claim:

1. A binding arrangement for securing a bundle of sheets together comprising:

a file portion including at least one part adapted to extend at least partially along at least one outer side of the bundle of sheets to be secured together;

a back portion secured to said file portion, said back portion including an element formed from a stiff, heat conducting material, said back portion and said file portion collectively defining a sheet receiving space with an inside surface of said element facing said sheet receiving space, a section of the at least one part of said file portion extending along the inside surface of said element; and an amount of hot melt glue provided in said sheet receiving space for retaining the bundle of sheets within said binding arrangements.

2. A binding arrangement according to claim 1, wherein said element consists of a flat strip.

3. A binding arrangement according to claim 1, further comprising a continuous outer covering extending around said file portion.

4. A binding arrangement according to claim 1, wherein the section of the at least part of said file portion is provided with at least one opening which allows direct heat transfer from said element to said amount of glue.

5. A binding arrangement according to claim 1, wherein the section of the at least one part of said file portion is tightly fitted to said element.

6. A binding arrangement according to claim 5, wherein the section of the at least one part of said file portion is clenched to said element.

7. A binding arrangement according to claim 5, wherein the section of the at least one part of said file portion is glued to said element.

8. A binding arrangement according to claim 7, wherein the section of the at least one part of said file portion is provided with an opening for receiving and improving adhesion with the glue used to secure the file portion to said element.

9. A binding arrangement according to claim 1, wherein said element evinces a U-shaped profile with spaced, substantially parallel legs that are interconnected.

10. A binding arrangement according to claim 9, wherein said said file portion includes first and second parts that are separately formed and respectively attached to the legs of said element.

11. A binding arrangement according to claim 9, further comprising a covering extending about said element.

12. A binding arrangement according to claim 10, wherein said file portion further comprises a back sheet extending between and integrally formed with said first and second parts.

13. A binding arrangement according to claim 10, wherein the first part of said file portion is formed separate from the second part thereof, each of said first and second parts being positioned adjacent to, but spaced from said element, said binding arrangement further comprising at least one connection strip which interconnects said first part, said element and said second part.

14. A binding arrangement according to claim 13, wherein each of the first and second parts of said file portion is made of transparent synthetic foil and said connection strip is made of a synthetic foil that is more supple than the transparent synthetic foil of said first and second pans.

15. A binding arrangement according to claim 13, wherein each of the first and second parts of said file portion is made of a stiff material and said connection strip is formed with folding zones.

16. A binding arrangement according to claim 15, wherein the first and second parts of said file portion are made of cardboard.

* * * * *

UNITED STATES PATENT AND TRADEMARK OFFICE

CERTIFICATE OF CORRECTION

PATENT NO. : 5,425,554
APPLICATION NO. : 08/133308
DATED : June 20, 1995
INVENTOR(S) : Saverio Lamanna It is certified that error appears in the above-identified patent and that said Letters Patent is hereby corrected as shown below:

Column 1, line 26, "GB 2.197.156" should be --GB 2.197.256--
Column 1, line 33, "GB 2.197.156" should be --GB 2.197.256--

Signed and Sealed this

Twenty-sixth Day of February, 2008

JON W. DUDAS
*Director of the United States Patent and Trademark Office*

US005425554C1

(12) EX PARTE REEXAMINATION CERTIFICATE (7671st)

United States Patent
Lamanna

(10) Number: US 5,425,554 C1
(45) Certificate Issued: Aug. 10, 2010

(54) BINDING ELEMENT

(75) Inventor: Saverio Lamanna, Milan (IT)

(73) Assignee: Unibind (Cyprus) Limited, Nicosia (CY)

Reexamination Request:
No. 90/009,366, Dec. 16, 2008

Reexamination Certificate for:

| | |
|---|---|
| Patent No.: | **5,425,554** |
| Issued: | **Jun. 20, 1995** |
| Appl. No.: | **08/133,308** |
| Filed: | **Oct. 8, 1993** |

Certificate of Correction issued Feb. 26, 2008.

(30) Foreign Application Priority Data

Oct. 9, 1992 (BE) ..... 9200880
Sep. 1, 1993 (EP) ..... 93202559

(51) Int. Cl.
*B42D 1/06* (2006.01)
*B42D 3/02* (2006.01)

(52) U.S. Cl. ..... 281/21.1; 281/15.1; 281/36; 281/37

(58) Field of Classification Search ..... None
See application file for complete search history.

(56) References Cited

U.S. PATENT DOCUMENTS

| | | | | |
|---|---|---|---|---|
| 4,141,100 | A | | 2/1979 | Domroe et al. |
| 4,244,069 | A | | 1/1981 | Hale |
| 4,898,405 | A | | 2/1990 | Pickering et al. |
| 5,061,139 | A | | 10/1991 | Zoltner |
| 5,066,182 | A | * | 11/1991 | Stonebraker et al. ..... 412/3 |
| 5,120,176 | A | * | 6/1992 | Bhatia et al. ..... 412/8 |
| 5,183,295 | A | * | 2/1993 | Barnette ..... 281/29 |

FOREIGN PATENT DOCUMENTS

| | | | |
|---|---|---|---|
| GB | 2 184 981 A | | 7/1987 |
| GB | 2197256 A | * | 5/1988 |

* cited by examiner

*Primary Examiner*—Cary E. Wehner

(57) ABSTRACT

A binding consists of a file composed of one or more parts. The back of the binding contains an element enclosed in a hard heat conducting material. An inside portion of the back is provided with an amount of glue which melts under the influence of heat for maintaining the file, at least partially, adjacent to the inside portion of the element.

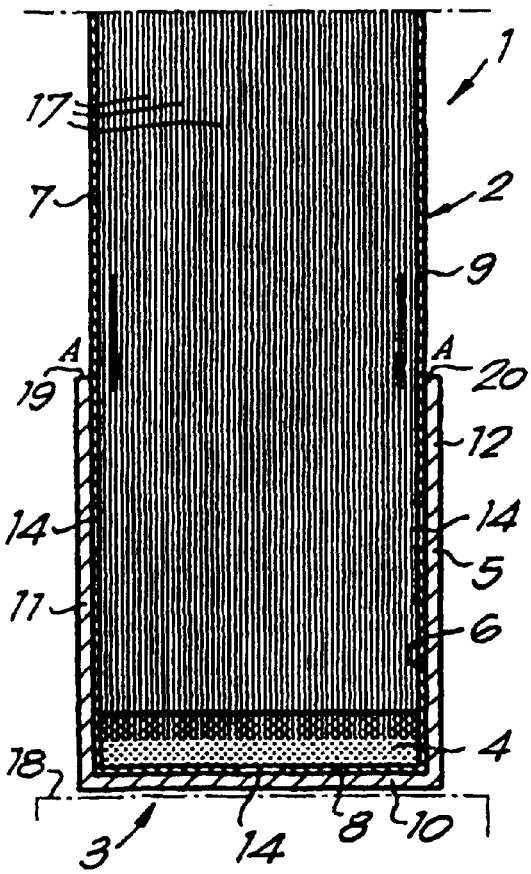

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 6 is cancelled.

Claims 1 and 10 are determined to be patentable as amended.

Claims 2, 3, 5, 7, 9,11-13, 15 and 16, dependent on an amended claim, are determined to be patentable.

New claims 17-26 are added and determined to be patentable.

Claims 4, 8 and 14 were not reexamined.

1. A binding arrangement for securing a bundle of sheets together comprising:

a file portion including at least one part adapted to extend at least partially along at least one outer side of the bundle of sheets to be secured together;

a back portion secured to said file portion, said back portion including an element formed from a stiff, heat conducting material, said back portion and said file portion collectively defining a sheet receiving space with an inside surface of said element facing said sheet receiving space, a section of the at least one part of said file portion extending along the inside surface of said element *and tightly secured to the element before securing the bundle of sheets together within said element*; and an amount of hot melt glue provided in said sheet receiving space for retaining the bundle of sheets within said binding arrangements.

10. A binding arrangement according to claim 9, wherein said [said] file portion includes first and second parts that are separately formed and respectively attached to the legs of said element.

*17. A binding arrangement according to claim 1, wherein said at least one part of said file portion comprises a continuous inner covering adapted to extend along substantially said entire element.*

*18. The binding arrangement according to claim 17, wherein said amount of hot melt glue is disposed on top of said at least one part of said file portion.*

*19. The binding arrangement according to claim 18, further comprising:*

*a layer of a second glue adhering said continuous inner covering to said inside surface of said element.*

*20. The binding arrangement according to claim 19, comprising:*

*said second glue being a member of the group consisting of a thermo-activatable glue having melting temperature higher than a melting temperature of said hot melt glue, a once-only thermo-activatable glue, and a non-thermic glue.*

*21. The binding arrangement according to claim 18, further comprising:*

*said element having a u-shaped profile.*

*22. A binding arrangement for securing a bundle of sheets together comprising:*

*a file portion including a front cardboard plate and a rear cardboard plate adapted to extend at least partially along a front outer side and a rear outer side of the bundle to be secured together;*

*a back portion secured to said file portion, said back portion including an element having a U-shaped cross section and formed from a stiff, heat conducting material, said back portion and said file portion collectively defining a sheet receiving space with an inside surface of said element facing said sheet receiving space,*

*said file portion including a continuous inner covering extending over an inside surface of said front cardboard plate and along the inside surface of said element and over an inside surface of said rear cardboard plate, said file portion tightly secured to said element before securing said bundle of sheets within said element; and*

*an amount of hot melt glue provided in said sheet receiving space on top of said continuous inner covering for retaining the bundle of sheets within said binding arrangement.*

*23. The binding arrangement according to claim 22, further comprising:*

*a continuous outer covering extending around said file portion.*

*24. The binding arrangement according to claim 23, comprising:*

*said continuous outer covering folded over at least one edge of said element.*

*25. The binding arrangement according to claim 23, comprising:*

*said continuous outer covering folded over at least one edge of said front cardboard plate and at least one edge of said rear cardboard plate.*

*26. A binding arrangement for securing a bundle of sheets together comprising:*

*a file portion including a front cardboard plate and a rear cardboard plate adapted to extend at least partially along a front outer side and a rear outer side of the bundle to be secured together;*

*a back portion secured to said file portion, said back portion including an element formed from a stiff, heat conducting material, said back portion and said file portion collectively defining a sheet receiving space with an inside surface of said element facing said sheet receiving space,*

*said file portion including a continuous inner covering extending over an inside surface of said front cardboard plate and along the inside surface of said element and over an inside surface of said rear cardboard plate, said file portion tightly secured to said element before securing said bundle of sheets within said element;*

*an amount of hot melt glue provided in said sheet receiving space on top of said continuous inner covering for retaining the bundle of sheets within said binding arrangement;*

*a continuous outer covering extending around said file portion, said continuous outer covering folded over at least one edge of said element; and*

*a layer of a second glue adhering said continuous inner covering to said inside surface of said element.*

* * * * *